US005172834A

United States Patent [19]

Wang

[11] Patent Number: 5,172,834

[45] Date of Patent: Dec. 22, 1992

[54] A DISPENSING CONTAINER CONVERTING RECIPROCATORY MOTION TO ROTARY MOTION TO MOVE A PRODUCT DISPENSING PISTON TO DISPENSE THE PRODUCT IN A FIXED AMOUNT

[76] Inventor: Philip Wang, No. 7, Kao-Cheng 9th Street, Pa-Teh Hsiang, Tao-Yan Hsien, Taiwan

[21] Appl. No.: 634,070

[22] Filed: Dec. 26, 1990

[51] Int. Cl.[5] ..... B67D 5/42

[52] U.S. Cl. ..... 222/320; 222/321; 222/387; 222/390; 222/391

[58] Field of Search ..... 222/320, 321, 387, 390, 222/391, 386

[56] References Cited

U.S. PATENT DOCUMENTS

| | | | |
|---|---|---|---|
| 2,991,915 | 7/1961 | Boehm | 222/320 |
| 2,998,167 | 8/1961 | Boehm | 222/320 |
| 4,753,373 | 6/1988 | Seager | 222/391 X |
| 4,848,598 | 7/1989 | McKinney | 222/391 |
| 4,850,516 | 7/1989 | Seager | 222/387 X |
| 4,865,231 | 9/1989 | Wiercinski | 222/391 X |

FOREIGN PATENT DOCUMENTS

| | | | |
|---|---|---|---|
| 0018180 | 9/1955 | Fed. Rep. of Germany | 222/321 |
| 0020271 | 10/1955 | Fed. Rep. of Germany | 222/320 |
| 0023702 | of 1893 | United Kingdom | 222/387 |
| 2146612 | 7/1984 | United Kingdom | 222/391 |

*Primary Examiner*—Andres Kashnikow
*Assistant Examiner*—Anthoula Pomrening
*Attorney, Agent, or Firm*—Wenderoth, Lind & Ponack

[57] ABSTRACT

A fluid container has a fixed delivery mechanism capable of moving a pusher piston forward to thereby discharge the contained fluid substance quantitatively through a discharge hole by a gentle push of a knob or cover and through a unidirectionally driven motion change mechanism. The container is capable of regulating the delivery amount by adjustment of the press stroke of a drive mechanism and also capable of squeezing out a large amount of the contained substance at one time by a short stroke push operation. Further embodiments of the container are provided having discharge action during both the press stroke and the return stroke by the recovery of a spring, whereby a double discharge amount is obtained and energy is saved.

19 Claims, 6 Drawing Sheets

DISPENSING CONTAINER CONVERTING RECIPROCATING MOTION TO ROTARY MOTION TO MOVE A PRODUCT DISPENSING PISTON TO DISPENSE THE PRODUCT IN A FIXED AMOUNT

BACKGROUND OF THE INVENTION

The present invention relates generally to a fluid container and, more particularly, to a push-knob fluid container capable of ejecting a fluid substance contained in the container in a fixed amount through an outlet pipe by pushing with a finger a knob provided at the top of the container cap.

A good many containers are available on the market for containing fluid substances, such as shampoo, washing cream and others. Since these containers are not generally of a type suitable for quantitative extraction of the contents, they must rely upon the observation and the sensation of pushing by the user to carefully release the contents for use. This is not only inconvenient in the manipulation and the use of the container, but because of excessive amount being squeezed out, this always results in wastage. Recently, there is known a kind of container where the fluid content can be extracted quantitatively by the push of a knob, such as the type of squeezable container for toothpaste. However, complicated constructions, relative difficulty in the production and higher cost are the drawbacks of this kind of container.

The invention has this for its aim the development of a push-knob fluid container solving the above known drawbacks.

Accordingly, an object of the present invention is to provide a novel push knob fluid container equipped with a fixed delivery mechanism, capable of moving a pusher piston forward to thereby deliver the contained fluid substance quantitatively through a discharge hole by a gentle push of a knob or the cover and through a unidirectionally driven motion change mechanism.

Another object of this invention is to provide a push-knob fluid container suitable for receiving and packaging hygienically in entirety all kinds of milk, cream or liquid fluid matter while being capable of delivering quantitatively the contained substance by simple manipulation.

Still a further object of the present invention is to provide a push-knob fluid container capable of regulating the delivery amount by the adjustment of the press stroke of a drive mechanism and also capable of squeezing out a large amount of the contained substance at one time by a short stroke push manipulation.

Another object of the present invention is to provide a push-knob fluid container capable of discharge action during both the press stroke and the return stroke by the recovery of spring whereby a double discharge amount is obtained and energy is saved.

A further object of the present invention is to provide a push-knob fluid container capable of achieving the aforesaid efficacy with the most simplified assembly construction and at the lowest cost of production.

BRIEF DESCRIPTION OF THE DRAWINGS

The above and other objects and advantages of the invention may be best understood from the following detailed description of the embodiments of the present invention illustrated in the drawings, wherein.

DETAILED DESCRIPTION OF THE PREFERRED EMBODIMENTS

Figure 1:
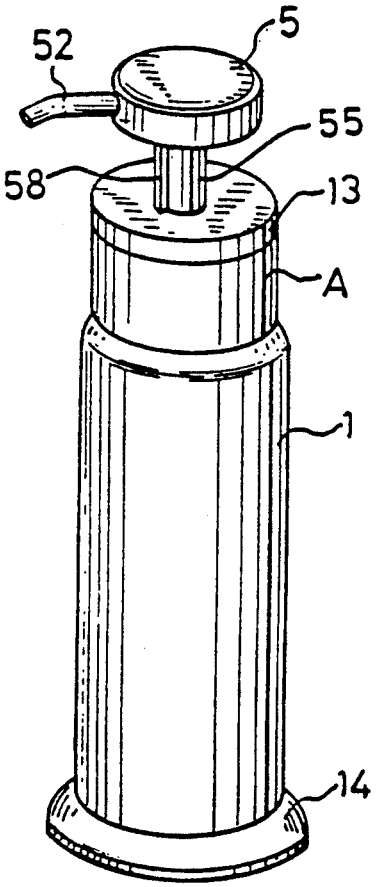
FIG. 1 is an external view of one embodiment of the fluid container of the invention.
Figure 2:
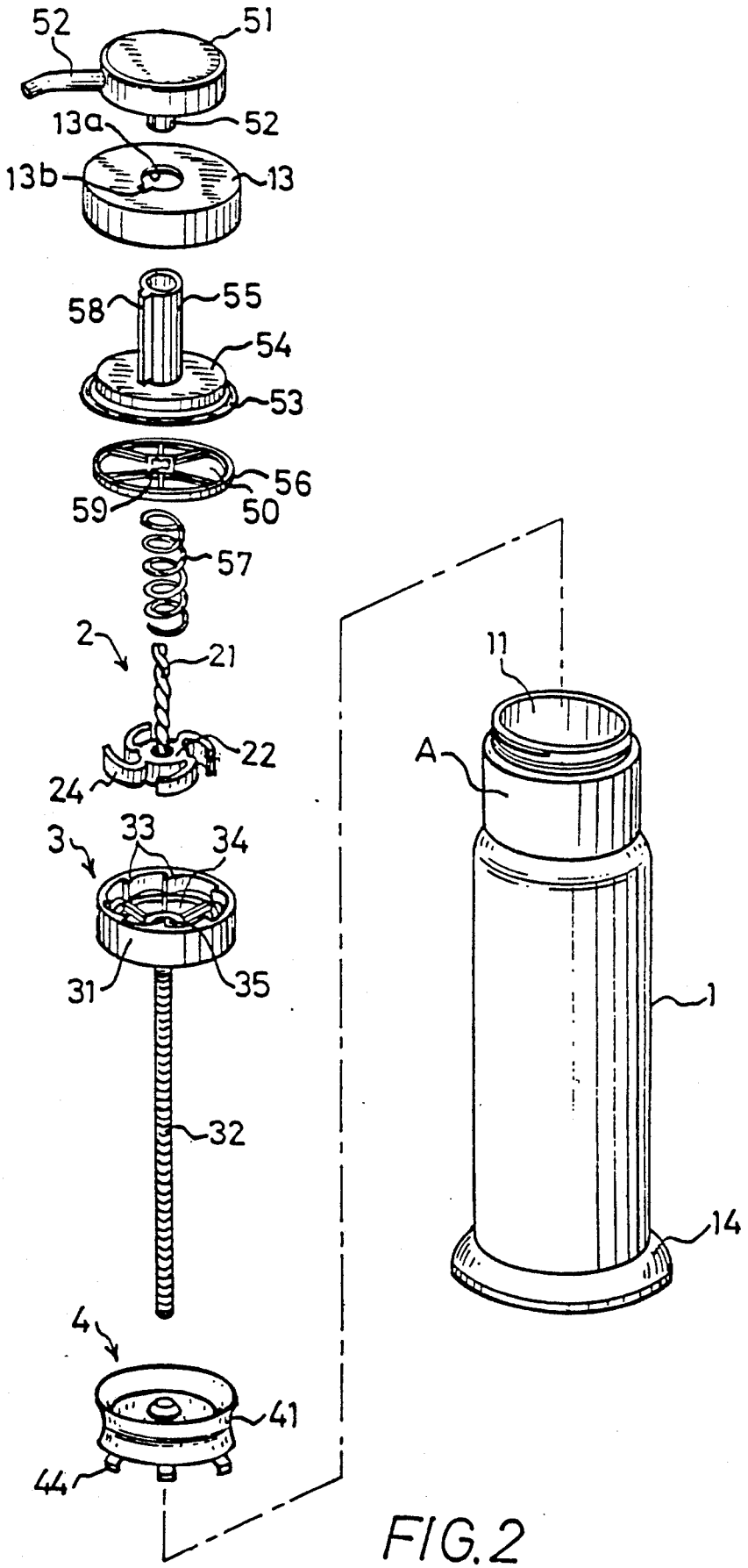
FIG. 2 is an exploded perspective view of the fluid container shown in FIG. 1.

Referring now to the accompanying drawings, embodiments of the fluid container of the present invention are described in detail as follows.

With particular reference to FIGS. 1 through 4, the fluid container of the invention comprises essentially a normally cylindrical container body 1, a drive mechanism 2 disposed inside a drive chamber A at the upper end of the container body 1 and capable of converting linear motion into rotary movement, a driven mechanism 3 disposed likewise in the drive chamber A of the container body 1 and having a screw rod 32 extending into the bottom inside the container 1 and driven by the drive mechanism 2 to be unidirectionally rotatable, a discharge or delivery piston 4 formed of elastic resin and provided at the lower end of the screw rod 32 of the driven mechanism 3 and capable of ascending along the screw rod 32 following the rotation of the latter to push the contained matter out, and a push knob 5 mounted on the upper part of the container body 1.

The container body 1 has openings 11 and 12 at the upper and lower ends, the opening 11 at the upper end being covered with a cap 13, whereas at the lower end there is provided a cylindrical body having a bugle-shaped bottom seat 14. On the inner wall at the upper end portion of the main body 1 there is located a circular plate-like support seat 16 having at its center a hole 15*a* and on the circumference formed with a plurality of through holes 15, whereas in between this supporting seat 16 and the upper cap 13 there is appropriately formed the drive chamber A. A central hole 13*a* formed on the cap 13 is provided with a projecting square positioning guide groove 13*b*.

Figure 3:
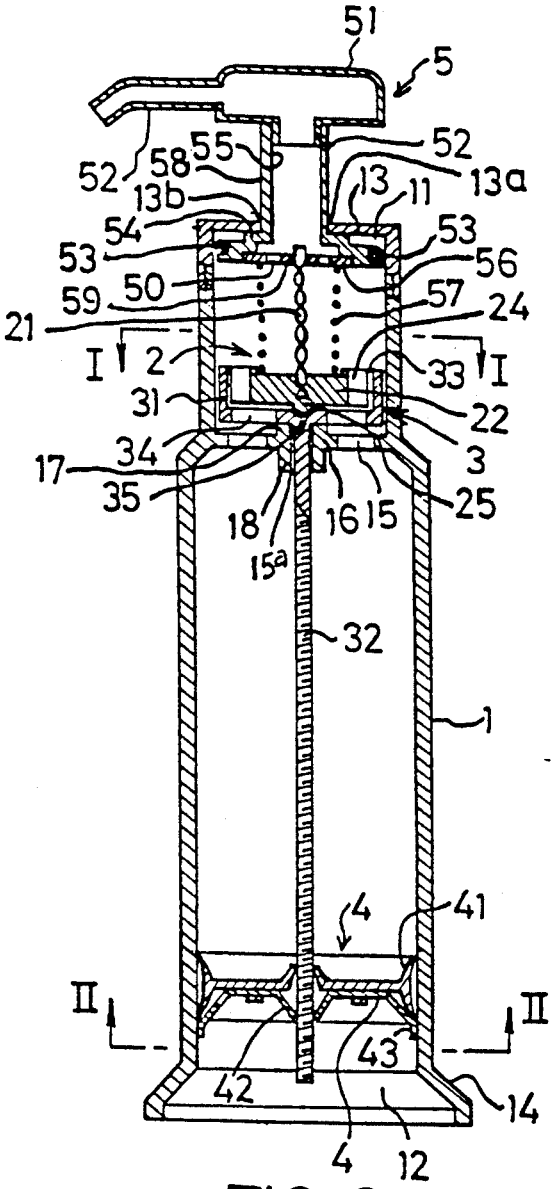
FIG. 3 is a longitudinal sectional view of the fluid container shown in FIG. 1.
Figure 4:
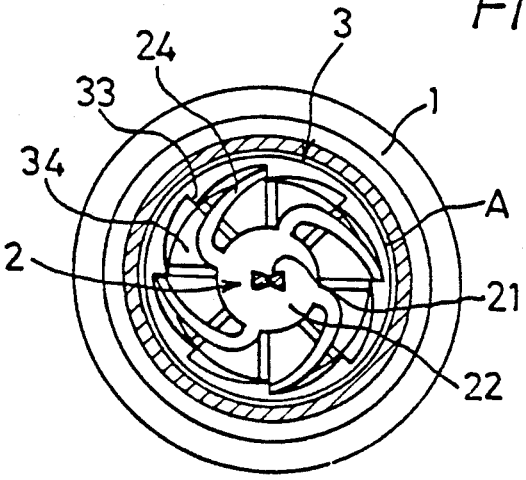
FIG. 4 is a sectional view of the fluid container taken along the line I—I of FIG. 3.

The drive mechanism 2, as shown in FIGS. 3 and 4, is located inside the drive chamber A and comprises a drive screw 21 of a large lead or lead angle and a drive pawl wheel 22 disposed at the lower end of the screw 21 and having a multiplicity of elastic pawls 24. This drive mechanism 2 is for converting the linear motion into rotary motion and drives the driven mechanism 3 to rotate.

The driven mechanism 3, as shown in FIG. 4, includes an internal pawl type ratchet wheel 31 disposed inside the drive chamber A and driven by the above pawl wheel 22 to be unidirectionally rotatable, and a guide screw rod 32 connected to the lower center of the ratchet wheel 31 and passing through the central hole 15*a* of the support seat 16 to extend into the lower end of the container body 1 for guiding the piston 4. The inside wall of the ratchet wheel 31 is provided with a plurality of unidirectional internal pawls 33 meshing with pawls 24 of the pawl wheel 22, whereas on a bottom plate thereof there is a plurality of penetration holes 34.

Figure 5:
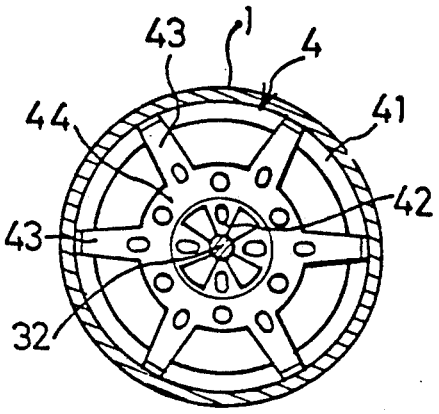
FIG. 5 is a sectional view of the fluid container taken along the line II—II of FIG. 3.

The delivery piston 4 is located in the interior of the container body 1, and when the container is filled with a contained fluid, the piston 4 is located at the lower part of the container body 1 and is screwed onto the lower end of the guide screw rod 32. As shown in FIG. 5, this piston comprises a cylindrical body 41 having its circumference closely touching the inside wall of the container body 1 and a metal nut member 44 embedded in the center of the upper or bottom wall of the piston body 41 and provided with a plurality of radially arranged internal pawls 42 and a plurality of external pawls 43. The internal pawls 42 of the nut member 44 mesh with the guide screw rod 32 and possess the function of a nut. The external pawls 43 are locked in engagement by their downwardly inclined angles and their elasticity at their ends with the inner circumferential wall of the container body 1, and are able to ascend readily along the said wall, but not descend. These external pawls 43 also will not rotate, but will shift unidirectionally only. In other words, the plurality of external pawls 43 has the function of stopping the descent so as to allow the piston 4 to ascend by the positive rotation of the guide screw rod 32. The piston 4, however, will not fall down because of the weight of the contained substance it is subjected to, nor will it turn reversely because of the reverse rotation of the drive pawls 22. In the place of the foregoing nut member 44, however, a nut may simply be used.

Push knob 5 comprises a head 51 having an L-shaped delivery pipe 52, a drive pipe 55 having a pipe orifice at an upper end connected to the delivery duct 52 of the head 51 and the lower end extending into the drive chamber A. The lower end is provided with a disc 54 having on its circumference a seal ring 53 and an axial guide ridge 58, a drive guide plate 56 mounted below the disc 54 of the drive pipe 55 and a knob-return spring 57 disposed in between the guide plate 56 and the drive pawl wheel 22. The drive guide plate 56 is defined in the center with a somewhat eight-shaped drive hole 59 screwed onto the upper end of the screw 21 of greater lead and is provided on its circumference with a plurality of through holes 50 capable of communicating with the drive pipe 55. Also, the guide plate 56 is constantly endowed with an upward pressure forcing the upper side of the disc 54 to press against the upper part inner side of the cap 13 by the force of the return spring 57.

The drive pawl wheel 22 and the driven ratchet wheel 31 described above constitute appropriately a unidirectionally rotating ratchet mechanism M. This is the unidirectional mechanism which, when the drive pawl wheel 22 rotates in the set direction, is capable of driving the driven ratchet wheel 31 and bringing the latter into rotation in the same direction by the pawls 24 and which, however, when the drive pawl wheel rotates in the reverse direction, will allow the pawls 24 to pass over the internal pawls 33 of the ratchet wheel 31 and not to drive the ratchet wheel 31. In order to reduce the frictional force between the bottom face of the pawl wheel 22 and the disc face of the ratchet wheel 31, the bottom face of the pawl wheel 22 preferably is provided at the center thereof with a small protuberance 25 to be engaged in a cavity 35 at the center of the ratchet wheel 31. In a separate arrangement, on the part of the central hole 15*a* of the support seat 16 there may also be formed a protuberance 17 to reduce the frictional force on the bottom face of the ratchet wheel 31. Below the protuberance 17 there may next be formed a downwardly extending cylindrical portion 18 to support the guide screw rod 32 permitting the latter to be more stable. Also in FIG. 3, preferably the screw rod 32 is provided at the upper part thereof with projections and the support seat 16 with an annular groove whereby the two can be engaged to each other so that in rotation the screw rod 32 will not separate and fall off from the support seat 16.

Figure 6:
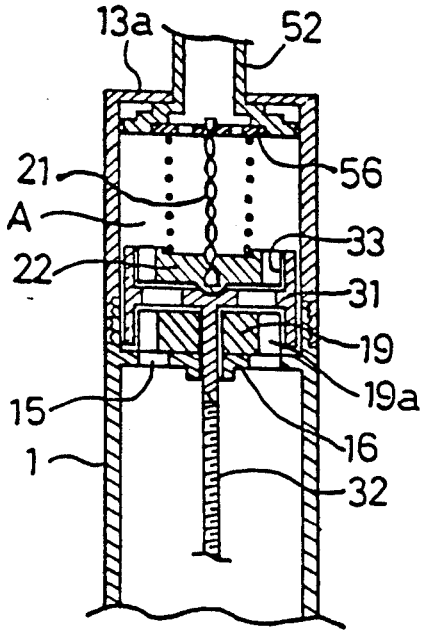
FIG. 6 is a sectional view of the essential parts of the second embodiment of the fluid container.

In the first embodiment described above, when the pawl wheel 22 rotates idly in the opposite direction, the frictional force produced in relation to the ratchet wheel 31 is set to be smaller than the frictional force needed to move the ratchet wheel 31 to rotate in the positive direction. For this reason, when the pawl wheel 22 rotates in the opposite direction, it will not bring the ratchet wheel 31 into rotation. At the same time, the engaging force between the external pawls 43 of the delivery piston 4 and the inner wall of the container will also make the ratchet wheel 31 not rotate in the opposite direction. However, to further ensure that the ratchet wheel 31 will not rotate in the reverse direction, as in the second embodiment of the present invention shown in FIG. 6, a fixed pawl wheel 19 having pawls directed oppositely to the pawls of the drive pawl wheel, similar to the aforesaid drive pawl wheel 22, maybe integrally formed above the support seat 16. The internal pawl portion 33 of the ratchet wheel 31 is allowed to extend downwardly to mesh with elastic pawls 19*a* of the fixed pawl wheel 19. In this way, during the positive rotation of the ratchet wheel 31 brought about by the pawl wheel 22, the pawls 33 of the ratchet wheel 31 are still able to slide over the elastic pawls 19*a* of the fixed pawl wheel 19. However, when the pawl wheel 22 rotates oppositely, this ratchet wheel 31 becomes pushed against by the pawls 19*a* and will not rotate. In fact, it is not necessary that the fixed pawl wheel 19 is of the same construction as the drive pawl wheel 22. Any elastic pawls, whether single pawls or double pawls, may be used in so far as the pawls have the same function and effect as the pawl wheel 19, that is, have the function to permit the ratchet wheel 31 to turn positively but prevent it from turning oppositely. In the first embodiment, again, the upper cap 13 is such that it covers superficially. It will also be possible to have a cap 13*a* of greater depth used if the height of the support seat 16 to the mouth of the container shortened as shown in FIG. 6. As to the joining of the upper cap 13 or 13*a* with the container body 1, in addition to the threaded connection, there may be applied a snap-on joint or any other appropriate joints. Furthermore, in the present embodiment the container body 1 and the upper cap 13 are of the same diameter.

Figure 7:
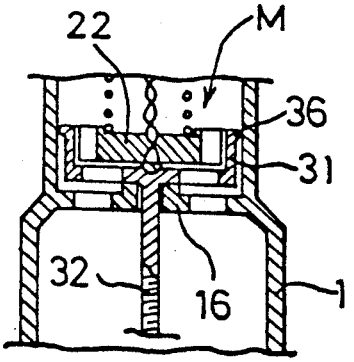
FIG. 7 is a sectional view of the essential parts of the third embodiment of the fluid container.

FIG. 7 illustrates the third embodiment of the present invention, in which, in order to reduce the frictional resistance produced between the outer circumferential wall of the driven ratchet wheel 31 and the inner circumferential wall of the container body 1 during operation, there are formed one or several annular raised lines 36 on the outer circumferential wall of the ratchet wheel 31 of the ratchet wheel mechanism M. It is to be understood that such raised lines 36 may be appropriately applied in the embodiments above mentioned and in embodiments hereinbelow described.

Figure 8:
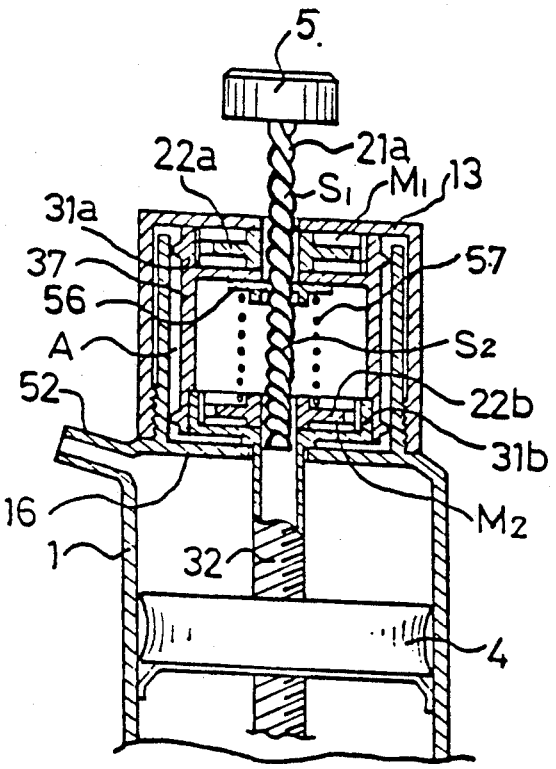
FIG. 8 is a sectional view of the essential parts of the fourth embodiment of the fluid container.

FIG. 8 illustrates a fourth embodiment of the present invention, which shows no difference in the basic making from those of the foregoing embodiments except in that, in order that the push knob 5 is able to still use its energy effectively to continuously drive the ratchet wheel 31 to discharge substance after the push knob 5 has been pressed and as the knob 5 is returning to its original position by the return spring 57, two sets of ratchet wheel mechanisms are used here. Specifically speaking, here in the drive chamber A there are arranged two completely similar upper and lower opposite units of ratchet mechanisms $M_1$, $M_2$, each unit including a set of drive pawl wheels 22*a*, 22*b* and driven ratchet wheels 31*a*, 31*b*. The two driven ratchet wheels 31*a*, 31*b* are connected together as a single body with a cylindrical wall 37 and the return spring 57 is disposed in between the two upper and lower ratchet wheels 31*a*, 31*b*. The drive screw 21*a* passes through the upper cap 13, the two pawl wheels 22*a*, 22*b* and the ratchet wheels 31*a*, 31*b* and is provided on the upper end thereof with a push knob 5, whereas the lower end thereof extends into a hole on the upper end portion of a hollow guide screw rod 32. The drive screw 21*a* is also firmly provided half-way with a stepwise positioning guide plate 56 also functioning as a check plate to press against the lower side of the upper ratchet wheel 31*a* by means of the spring 57. The screw 21*a*, with this stepwise positioning check plate 56 as a mark is divided into an upper section $S_1$ having a right-handed thread or screw and a lower section $S_2$ forming the left screw, while at the same time, the guide screw rod 32 forms a right screw. In this way, when the screw 21*a* is pressed to move downwardly, the upper ratchet wheel mechanism $M_1$ is thus driven by the right screw $S_1$ of the upper section to turn positively thereby bringing the guide screw rod 32 into rightward rotation to further force the piston 4 to ascend. The lower ratchet wheel mechanism $M_2$ being driven by the left screw $S_2$ of the lower section, however, performs race rotation, that is, the lower pawl wheel 22*b* does not drive the lower ratchet wheel 31*b*. The screw 21*a* ascends by the force of the spring 57 when the push knob 5 is let go and during this time the lower ratchet wheel mechanism $M_2$, being driven by screw $S_2$ of the lower section, is rotating in the rightward direction, while concurrently the upper ratchet wheel mechanism $M_1$ driven by the screw $S_1$ of the upper section performs race rotation. Hence, the guide screw rod 32 under the drive of the lower ratchet wheel mechanism $M_2$ continues to rotate in the rightward direction and the piston 4 is still able to ascend continuously and to press the contained substance until the stepwise positioning check plate 56 reaches and is in contact with the bottom face of the upper ratchet wheel 31*a*. The drive pawl wheels 22*a*, 22*b* have in their center eight-shaped holes so that they also function to drive the guide plate. In this embodiment, the upper portion of the container body 1 is provided near the drive chamber A with a discharge hole 52 passing into the interior of the container 1. Therefore, when the piston 4 ascends, the contained substance can be ejected out through the discharge hole 52. To adopt such a side delivery system, it is, however, preferred that the support seat 16 is formed in a closed body to avoid the contained substance entering into the drive chamber A. In the present embodiment, the moving mechanisms $M_1$, $M_2$ inside the drive chamber A are able to perform even smoother and swifter actions. Apparently, the construction of the container with side discharging can also be applied in the above described first to third embodiments, in which it is only required that the container body 1 is provided on one side at the upper portion thereof with a discharge hole and the support seat 16 is made a closed body, and at the same time the push knob 5 is made a simple structure without the delivery pipe 52. In this way, it is possible to manufacture the drive mechanisms to be even more compact and handy so that the volume thereof occupying the container is reduced.

Figure 9B:
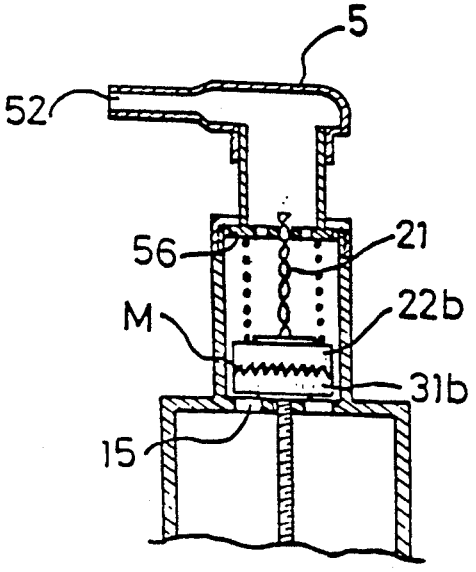
FIGS. 9A and 9B are sectional views of the essential parts in two aspects of the fifth embodiment of the fluid container.
Figure 9A:
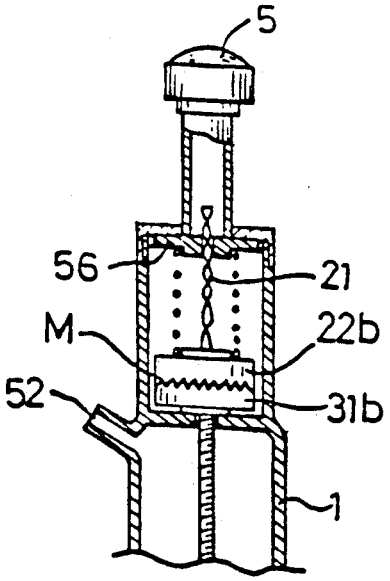

FIG. 9A shows a fifth embodiment of the push-knob fluid container of the present invention, in which a unidirectional crown gear mechanism is used in place of the aforesaid ratchet wheel mechanism M. In the present embodiment, the aforesaid drive pawl wheels 22, 22*a* and the driven ratchet wheels 31, 31*a* are essentially substituted by a drive gear 22*b* capable of driving unidirectionally only and a driven gear 31*b*, while other structures remain unchanged. In this embodiment, the discharge hole 52 is for side delivery, and hence a simple knob is used for the push knob 5, having no delivery pipe. FIG. 9B illustrates the fifth embodiment of the invention, in another aspect of variation, with the discharge hole 52 located in the push knob 5.

Figure 10:
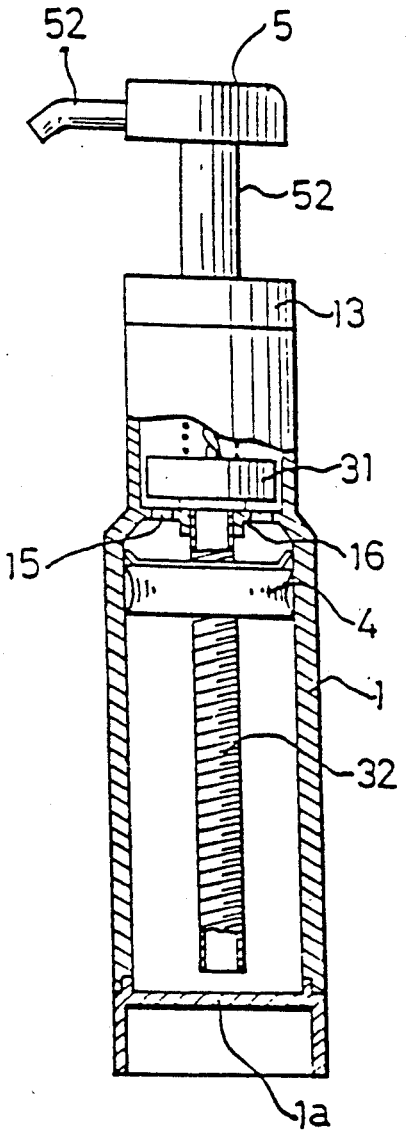
FIG. 10 is a sectional view of the sixth embodiment of the fluid container.

FIG. 10 shows a sixth embodiment of the present invention. Whereas in all the foregoing embodiments the piston 4 has been described as being lifted up along the guide screw rod 32 under the weight of the contained substance to squeeze out the contained substance, in the present embodiment the piston 4 is mounted on the upper part of the guide screw rod 32. With the arrangement, when the guide screw rod 32 is driven by the ratchet wheel mechanism M the piston 4 is lowered along the guide screw rod 32 to squeeze the contained sustance for delivery through the discharge hole 52. Therefore, the piston 4 is normally not under the weight of the contained substance and thus enables its operation to be easier. In order to achieve the function, it is necessary that the container be appropriately modified and by this, the container body 1 is formed with a bottom 1*a* and the guide screw rod 32 is made into a hollow pipe having on the upper end openings passing into the drive chamber A. The support seat 16 is formed in a closed body and the threads on the guide screw rod 32 are formed to be opposite to the direction of rotation of the driven ratchet wheel 31. In this way, the piston 4 moves from up to down to squeeze the contained substance during the rotation of the guide screw rod 32.

Figure 11:
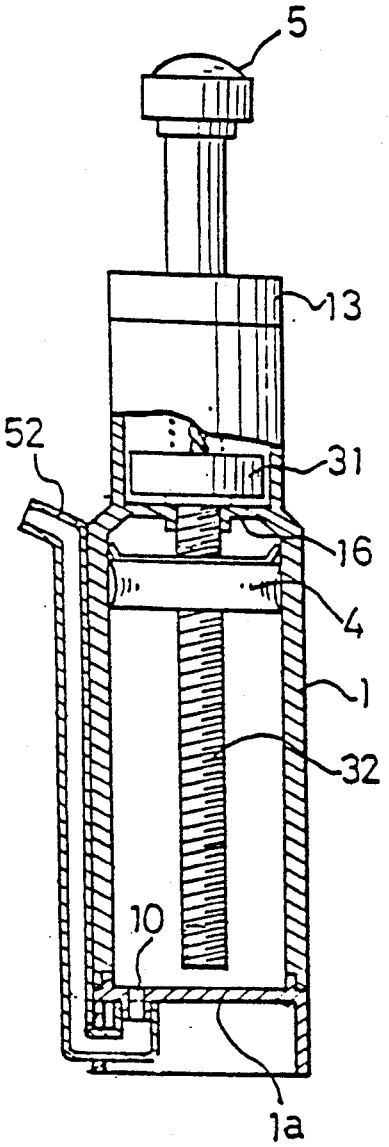
FIG. 11 is a sectional view of the seventh embodiment of the fluid container.

A seventh embodiment according to the present invention, as shown in FIG. 11, is another embodiment of the piston 4 pressing downwardly from the above. In this, the upper end of the guide screw rod 32 and the support seat 16 are closed, however, a hole 10 is defined on the bottom 1*a* of the container body 1. This hole 10 is connected with an L-shaped delivery pipe 52 to project outwardly after it has upwardly extended to the apex of the body along the bottom 1*a* of the container body and the outer side wall so that during the descent of the piston 4 it enables the contained substance to be squeezed and ejected out from this delivery pipe 52.

It is to be noted that the configuration of the embodiment in which the piston presses downwardly, as shown in FIGS. 10 and 11, can be also applied in the aforesaid first to fifth embodiments.

Now, the conditions of use of the push-knob squeeze container of the present invention will be described hereinbelow.

Given that the contained fluid substance, whether milky, cream like or solution type, is received in the container, all that is required now is only to press down the push knob 5. The push knob 5 immediately drives the ratchet wheel mechanisms M, $M_1$, $M_2$ to rotate by the drive guide plate 56 working against the force of the spring 57. Immediately, the guide screw rod 32 is moved to rotate by the mechanisms M, $M_1$, $M_2$ and following the rotating guide screw rod 32 the piston 4 moves either from top to bottom, as illustrated in FIGS. 1 through 9, or from bottom to top, as depicted in FIGS. 10 and 11, to squeeze out the contained substance through the delivery pipe 52. Because of the fixed pressing stroke of the push knob 5, the stroke of movement in the piston 4 is also fixed and there is thus a fixed amount discharged upon the pressing of the knob each time.

Figure 12:
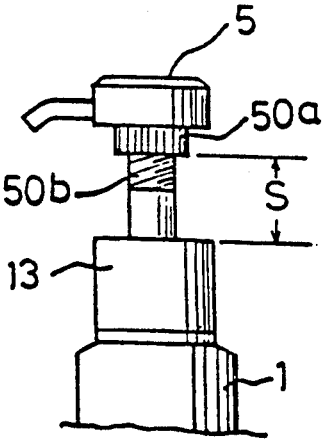
FIG. 12 is a schematic view of the essential parts of an embodiment of the push-knob having an adjustable press stroke.

In the container of the present invention, in order that the amount discharged can be altered according to the necessity of the user, this can be achieved by a mere change of the travel of the push knob 5. In one of the possible configurations as shown in FIG. 12, the push knob 5 is provided at the lower part with a regulating nut 50*a* screwed onto a threaded portion 50*b* formed on the outer circumference of the pipe or rod projecting at the lower end thereof. By regulating the nut 50*a* it is possible to alter the pressing stroke S to further change the amount delivered. The amount delivered each time by the container is proportional to the length of the pressing stroke of the knob. Furthermore, the container body 1 is not to be limited to the cylindrical body, it is also possible if polygon cylinders such as hexagon cylinders, octagon cylinders, or other cylindrical bodies of appropriate shape are used.

For the piston 4, it is to be noted that the application of the above described is optional. Any type of construction is appropriate as long as the the piston is provided at its center with a nut member capable of being movably screwed onto the guide screw rod following the movement of the guide screw and the center and the circumference, are capable of keeping the contained substance from leaking and capable of closely touching, in opposite movement, the inner wall of the container body.

The foregoing is a description of the preferred embodiments of the invention and it should be understood that variations may be made thereto without departing from the spirit of the invention as defined in the appended claims.

I claim:

1. A fluid dispenser, comprising:

a generally cylindrical body having a substance containing portion, a drive chamber at an upper part thereof and an outlet;

driving means located inside said drive chamber for converting linear motion to rotary motion, said driving means including a unidirectionally driving crown gear having a drive screw with a predetermined lead angle;

driven means located inside said drive chamber of said generally cylindrical body having a threaded rod extending in said generally cylindrical body for unidirectionally rotating said threaded rod, said driven means including a driven crown gear having said threaded rod connected thereto and meshing with said unidirectionally driving crown gear to be driven and unidirectionally rotated thereby;

a piston on said threaded rod of said driven means inside said cylindrical body and capable of axially moving along said threaded rod during the rotation of said threaded rod; and a push-knob mounted on the upper part of said generally cylindrical body movable downwardly into said body for driving said driving means, whereby said fluid dispenser dispenses a contained substance in a set amount through said outlet by said piston being forced to move axially along said threaded rod when motion produced by said push knob is converted into rotary motion to drive said driven means.

2. The fluid dispenser of claim 1, and further comprising a support seat in said generally cylindrical body comprising a seal plate sealing said drive chamber from the substance containing portion of said generally cylindrical body, said outlet comprising a delivery pipe directly connecting with said substance containing portion.

3. A fluid dispenser, comprising:

a container body having a fluid containing portion, a drive chamber and a dispensing outlet;

a push-knob reciprocably mounted on said container body so as to be moveable toward and away from said drive chamber;

a drive means in said drive chamber for converting reciprocal movement of said push-knob into rotary motion, said drive means including a screw having a predetermined lead angle;

a threaded rod extending in said fluid containing portion of said container body;

a piston engaging said threaded rod such that said piston is axially moveable in said container body along said threaded rod in response to rotation of said threaded rod;

driven means in said drive chamber in unidirectional rotation driving engagement with said drive means for rotating said threaded rod to axially move said piston in response to said drive means converting reciprocal movement of said push-knob into rotary motion.

4. The fluid dispenser of claim 3, wherein said drive means further has a drive guide plate connected with said push-knob and threadedly engaged with said screw having a predetermined lead angle such that reciprocal movement of said push-knob reciprocably moves said drive guide plate and turns said screw.

5. The fluid dispenser of claim 4, wherein said push-knob has a passage therein forming said dispensing outlet, said drive guide plate having openings therein communicating with said passage.

6. The fluid dispenser of claim 4, wherein said drive means further comprises a unidirectionally driving crown gear connected to said screw and said driven means further comprises a driven crown gear meshing with said driving crown gear and connected to said threaded rod.

7. The fluid dispenser of claim 3, wherein said container body has a seal plate sealing said fluid containing portion from said drive chamber.

8. The fluid dispenser of claim 3, wherein a spring biases said push-knob away from said container body.

9. The fluid dispenser of claim 3, wherein said drive means further comprises a drive pawl wheel connected to said screw and said driven means further comprises a driven ratchet wheel unidirectionally driven by said drive pawl wheel and connected to said threaded rod.

10. The fluid dispenser of claim 9, wherein said drive pawl wheel is centrally rotatably supported in said driven ratchet wheel and said driven ratchet wheel is centrally rotatably supported by a support seat separating said drive chamber and said fluid containing portion, said support seat having a central hole through which said threaded rod extends.

11. The fluid dispenser of claim 9, and further comprising means for preventing said driven ratchet wheel from rotating in the direction opposite to the direction of driving of said drive pawl wheel.

12. The fluid dispenser of claim 11, wherein said means for preventing comprises a support seat having a fixed pawl wheel thereon with pawls directed oppositely to the pawls of said drive pawl wheel of said drive means and meshing with said driven ratchet wheel.

13. The fluid dispenser of claim 9, wherein said push-knob has a passage therein defining said outlet, said passage extending into said drive chamber and having a drive guide plate fixed thereto at the interior end thereof, said drive guide plate being threadedly engaged with said screw such that reciprocation of said drive guide plate rotates said screw, and a spring being disposed between said drive guide plate and said drive pawl wheel.

14. The fluid dispenser of claim 3, and further comprising means for adjusting the amount of reciprocal movement of said push-knob.

15. The fluid dispenser of claim 3, wherein said screw is fixed to said push-knob and has a first threaded section and a second threaded section threaded in a direction opposite to said first threaded section, said drive means further comprising a first drive pawl wheel engaged with said first threaded section and a second drive pawl wheel engaged with said second threaded section, and said driven means further comprising first and second driven ratchet wheels connected together and connected to said threaded rod and engaging said drive pawl wheels.

16. The fluid dispenser of claim 15, wherein said screw has a positioning guide plate thereon between said first and second threaded sections.

17. The fluid dispenser of claim 3, wherein said piston comprises a nut member threaded on said threaded rod and an outer circumferential portion engaging the interior wall of said fluid containing portion.

18. The fluid dispenser of claim 17, wherein said piston is formed of elastic resin and said nut member is metal, said nut member having a plurality of centrally located internal pawls engaging said threaded rod and a plurality of external pawls engaging said interior wall to permit only unidirectional movement of said piston along said wall and to prevent oppositely directed and rotational movement.

19. The fluid dispenser of claim 3, wherein said container body has a closed bottom, has said drive chamber located at the top thereof, and said threaded rod has a screw thread thereon directed oppositely to the direction of rotation produced by said drive means such that said piston travels from the top of said container body along said threaded rod toward the bottom of said container body.

* * * * *